US010020628B2

(12) United States Patent
Pemwieser et al.

(10) Patent No.: US 10,020,628 B2
(45) Date of Patent: Jul. 10, 2018

(54) METHOD FOR PRODUCING A WATER-TIGHT PLUG CONNECTOR

(71) Applicant: ROSENBERGER HOCHFREQUENZTECHNIK GMBH & CO. KG, Fridolfing (DE)

(72) Inventors: Manuel Pemwieser, Burghausen (DE); Andrea Bippus, Teisendorf (DE); Martin Zebhauser, Laufen (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 0 days.

(21) Appl. No.: 15/564,595

(22) PCT Filed: Mar. 3, 2016

(86) PCT No.: PCT/EP2016/000376
§ 371 (c)(1),
(2) Date: Oct. 5, 2017

(87) PCT Pub. No.: WO2016/162102
PCT Pub. Date: Oct. 13, 2016

(65) Prior Publication Data

US 2018/0090897 A1 Mar. 29, 2018

(30) Foreign Application Priority Data

Apr. 7, 2015 (DE) ..... 10 2015 004 486

(51) Int. Cl.
*H01R 43/00* (2006.01)
*H01R 13/50* (2006.01)
*H01R 13/52* (2006.01)
*H01R 13/447* (2006.01)
*H01R 13/516* (2006.01)

(52) U.S. Cl.
CPC ..... *H01R 43/005* (2013.01); *H01R 13/447* (2013.01); *H01R 13/501* (2013.01); *H01R 13/516* (2013.01); *H01R 13/52* (2013.01)

(58) Field of Classification Search
CPC ..... H01R 43/005; H01R 43/16; H01R 43/18; H01R 13/52
See application file for complete search history.

(56) References Cited

U.S. PATENT DOCUMENTS 8,619,413 B2 * 12/2013 Gausepohl ..... H01R 13/5216 174/50
2004/0008532 A1 1/2004 Asawa
(Continued)

FOREIGN PATENT DOCUMENTS

EP 1587176 A1 10/2005
EP 2458691 A1 5/2012

*Primary Examiner* — Briggitte R Hammond
(74) *Attorney, Agent, or Firm* — DeLio, Peterson & Curcio, LLC; Robert Curcio

(57) ABSTRACT

A method for producing a water-tight plug connector in which at least one electric conductor such as a wire is introduced into a guide channel of an insulator part via a lateral opening in order to hold the conductor. The insulator part with the introduced conductor is arranged in a plug connector housing, and the lateral opening of the insulator part is closed by a cover. An internal volume of the plug connector housing is then at least partly filled with a sealing compound. A plug connector is produced in such a manner.

16 Claims, 2 Drawing Sheets

(56) References Cited

U.S. PATENT DOCUMENTS

2007/0232140 A1 10/2007 Tyler
2013/0189865 A1* 7/2013 Zaiser ..... H01R 13/52
439/190

* cited by examiner

METHOD FOR PRODUCING A WATER-TIGHT PLUG CONNECTOR

BACKGROUND OF THE INVENTION

1. Field of the Invention

The invention relates to a method for producing a water-tight plug connector in which at least one electrical conductor is introduced into a guide channel of an insulator part via a lateral opening in order to hold the conductor, the insulator part with the conductor is arranged in a plug connector housing, and an internal volume of the plug connector housing is then at least partially filled with a sealing compound.

2. Description of Related Art

As a result of the filling of the internal volume of the plug connector housing with the insulator part arranged therein, the insulator part together with the conductors are on the one hand fixed in the plug connector housing and integrally connected with same, producing a generally more stable and durable plug connector. On the other hand, if the sealing compound is fluid-tight, the penetration of water or other liquids into the interior of the plug connector housing is prevented, so that no water can penetrate into the interior of the plug connector housing as far as the conductors and potentially cause damage.

A hardenable adhesive cement such as a polymer resin compound can for example be used as the sealing compound.

It has been found that the course of at least one conductor within a guide channel of the insulator part of a water-tight plug connector can change as a result of the filling of the plug connector housing, which can have negative effects on the electrical and mechanical properties of the plug connector and the transmission of signals by means of the plug connector.

SUMMARY OF THE INVENTION

In view of the problems described, it is the object of the present invention to provide a water-tight plug connector with an insulator part cast into a plug connector housing which, despite being filled, possesses optimal mechanical and electrical properties.

This problem is solved through a further development of the method described herein with the method steps according to the invention as described in the claims. In the manufacturing method according to the invention, the lateral opening of the guide channel of the insulator part is at least partially closed after introducing the at least one conductor into the guide channel, prior to filling the plug connector housing.

The above and other objects, which will be apparent to those skilled in the art, are achieved in the present invention which is directed to a method for producing a water-tight plug connector in which at least one electric conductor is introduced into a guide channel of an insulator part via a lateral opening in order to hold the conductor, the insulator part with the introduced conductor is arranged in a plug connector housing, and an internal volume of the plug connector housing is then at least partially filled with a sealing compound, such that the lateral opening is closed prior to filling. The lateral opening is covered with a cover. The cover is attached to the insulator part so as to swivel around a swivel axis, and is swiveled into a closed position in which it lies against an at least partially peripheral edge of the lateral opening. The cover may be locked into a closed position.

The cover may further include a cover surface for covering the lateral opening and at least two locking elements projecting transversely to the cover surface, with engaging sections which are each clipped into a clip-in opening of the insulator part.

The plug connector is, in a preferred embodiment, an angle plug connector, such that the at least one conductor is substantially introduced into the insulator part through the lateral opening in a plugging direction (S) of the plug connector and runs in such a curve that it emerges from the insulator part on the cable side at an angle to the plugging direction (S).

In a second aspect, the present invention is directed to a water-tight plug connector having at least one electric conductor introduced into a guide channel of an insulator part via a lateral opening in order to hold the conductor, the insulator part with the introduced conductor being arranged in a plug connector housing, and an internal volume of the plug connector housing then being at least partially filled with a sealing compound, such that the lateral opening is closed prior to filling, the insulator part cast into a plug connector housing with a guide channel within which the at least one electrical conductor is held, such that a lateral opening of the guide channel of the insulator part is closed with a cover.

The cover is connected with the insulator part via a hinged joint and is swiveled into a closed position in which it lies against an edge of the insulator part which at least partially surrounds the lateral opening.

The plug connector may further include a locking mechanism holding the cover in a closed position with locking elements projecting from a cover surface of the cover with engaging sections which engage in clip-in openings of the insulator part.

In a third aspect, the present invention is directed to an insulator part for a water-tight plug connector, the insulator part having a guide channel for receiving at least one electric conductor via a lateral opening in order to hold the conductor, the insulator part with the introduced conductor being arranged in a plug connector housing, and an internal volume of the plug connector housing then being at least partially filled with a sealing compound, such that the lateral opening is closed prior to filling, the insulator part cast into a plug connector housing with a guide channel within which the at least one electrical conductor is held, such that a lateral opening of the guide channel of the insulator part is closed with a cover.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1A:
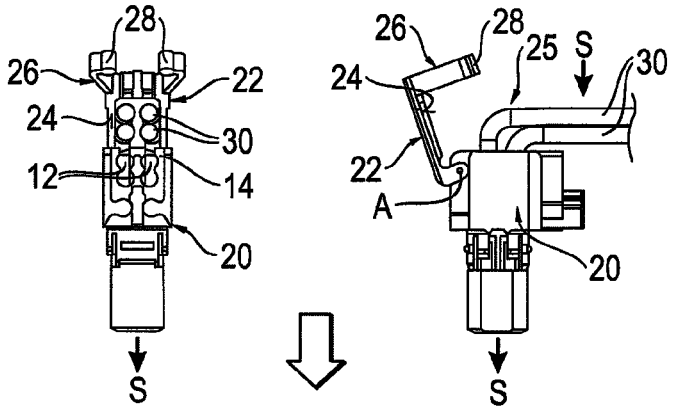
FIGS. 1*a* to 1*d* depict four steps in the manufacture of a plug connector by the method according to the invention, wherein two side views are illustrated.

In describing the preferred embodiment of the present invention, reference will be made herein to FIGS. 1-3 of the drawings in which like numerals refer to like features of the invention.

The invention is based on the knowledge that, after a conductor has been introduced into the guide channel of the insulator part via a lateral opening, a paste-like or viscous sealing compound can, during filling, penetrate through the open lateral opening into the interior of the insulator part, as far as the guide channel, as a result of which the course of the conductor in the guide channel can be changed.

For example, the sealing compound which has penetrated into the guide channel undergoes a change in volume during the hardening process, as a result of which the conductor can be pressed mechanically against a wall of the guide channel or against the adjacent conductor. A change of the dielectric between several conductors and/or a change in the spacing between them through the sealing compound influences the characteristic impedance and other electrical properties. Also, the contact points between the conductors and the contact elements in the interior of the insulator part can be subjected to mechanical loads, for example tensile loads, through the penetrated sealing compound, as a result of which the durability of the plug connector can be reduced.

At least one electrical conductor can be in the form of a wire, a core, a stranded conductor, a cable or similar. Preferably, the insulator part has several guide channels running next to one another, into each of which a conductor is introduced from the side. For example, the conductor is pushed or clipped into the relevant guide channel via the lateral opening in such a way that it emerges from the insulator part or from the guide channel at a cable-side end.

The insulator part has, on the one hand, a plug-side end with a plug interface carrying several contact elements which is designed to allow coupling with a mating plug connector in a plugging direction S, and on the other hand it has the cable-side end at which the conductors emerge from the insulator part. The conductors can be connected electrically with the contact elements of the plug interface within the interior of the insulator part.

Through the step of closing the lateral opening after introducing at least one conductor, a penetration of sealing compound into the interior of the insulator part is minimized and preferably completely prevented. The lateral opening need not necessarily be sealed in a water-tight or gas-tight manner. A significantly lesser degree of sealing is sufficient, since the viscous sealing compound cannot penetrate through small cracks or gaps.

The lateral opening of the insulator part can be closed in any chosen way. In order to achieve a good seal and simple assembly it has proved expedient if the lateral opening is covered with a cover. The cover can be designed as a separate covering which is laid in position and connected with the insulator part from the side. Alternatively, the cover can be attached adjustably to the insulator part in such a way that it can be moved from an open position in which it exposes the lateral opening for the purpose of introducing the conductors into a closed position in which it closes the lateral opening.

Preferably, at the cable-side end of the insulator part at which the conductors emerge from the insulator part, a flexible contact region of the insulator part rests laterally, under pressure, against the conductors, in a sealing manner, so that a penetration of sealing compound into the guide channel is also prevented at the cable-side end of the insulator part. For this purpose, the cover can have a pressure region, designed to press the contact region of the insulator part against the conductors in the closed position, between which the conductors are passed.

The lateral opening which is to be closed according to the invention preferably borders the guide channel laterally, at least in sections, and not necessarily (but possibly additionally) at its cable-side end, at which the conductors emerge from the insulator part.

According to a particularly preferred embodiment of the invention, the cover is attached to the insulator part so as to swivel around a swivel axis and is swiveled into a closed position in which it closes the lateral opening, at least partially, and preferably completely. In other words, the cover is a hinged cover.

For example, in the closed position the cover preferably lies peripherally against an edge of the lateral opening, so that no sealing compound can penetrate through between the edge and the cover lying against it.

In order to prevent the cover from becoming released again from the closed position, it is preferably locked in the closed position, whereby a snap-locking mechanism can be provided between the cover and the insulator part for this purpose.

A good and reliable closure of the lateral opening can be achieved in that the cover has a cover surface for covering the lateral opening. A good and reliable locking of the cover can be achieved in that at least one, preferably two locking elements with engaging sections project from the cover surface which are each clipped into an engaging recess such as a clip-in opening of the insulator part.

The locking elements preferably project substantially perpendicularly from the cover surface and are in the form of flexible struts or rods. The flexible struts or rods can project on two sides of the cover surface of the cover in such a way that in the closed position of the cover they enclose the conductors on the cable-side end of the insulator part between them and, after being clipped into the respective clip-in openings, press a contact section of the insulator part against the conductors. In this way, a penetration of sealing compound at the cable-side end of the guide channels can be reliably prevented.

By pressing the two flexible struts or rods together in the direction of the insulator part, the engaging sections, which each have a widened region, are clipped into the associated clip-in opening of the insulator part.

According to a particularly preferred embodiment, the plug connector manufactured according to the invention is an angle plug connector in which the plugging direction is oriented at an angle of preferably ninety degrees (90°) to the direction in which the conductors emerge from the plug connector housing. In other words, the guide channel in angle plug connectors has a curve or curvature of preferably around 90°. In an angle plug connector, it is not possible to introduce the conductors into the plug connector into the guide channels in a linear manner via the cable-side opening; instead, due to the curved course of the guide channels, the conductors must be introduced into the guide channels, at least partially, via a side opening, which makes the insulator part particularly susceptible to the penetration of sealing compound during filling.

According to the method according to the invention, the at least one conductor is preferably substantially introduced into the insulator part through the lateral opening, in the plugging direction of the plug connector, and has such a curved course or is bent in such a way that it emerges from the insulator part on the cable side at an angle, in particular roughly perpendicular to the plugging direction. The lateral opening can then be closed with the cover.

In order to achieve the transmission of several signals and/or currents, it is advantageous if more than one conductor, in particular two, three, four or more conductors, for example wires or stranded conductors, are introduced via the lateral opening into an associated guide channel of the insulator part and the lateral opening is then closed with the cover. In cross section, preferably four guide channels run next to one another within the interior of the insulator part in roughly square arrangement.

The plug connector housing into which the insulator part is cast preferably has a fastening section for attachment of the plug-side end of the insulator part and a trough section accommodating the main body of the insulator part which is filled with the sealing compound during filling. Following the filling, the sealing compound is preferably hardened by means of UV radiation and the plug connector housing is then closed.

According to a further aspect, the present invention relates to a water-tight plug connector such as can be manufactured according to the method according to the invention. A plug connector according to the invention has an insulator part cast into a plug connector housing with at least one guide channel within which an electrical conductor is held. The conductors emerge at a cable-side end from the guide channel. A lateral opening of the guide channel of the insulator part is closed by means of a cover. Because of the cover, a penetration of the viscous sealing compound into the interior of the insulator part through the lateral opening during filling of the plug connector housing can be prevented. Consequently, the interior of the insulator part of the plug connector according to the invention is preferably completely free of sealing compound, which leads to advantageous mechanical and electrical properties of the plug connector.

Preferably, the cast insulator part has four guide channels running next to one another, in each of which a conductor is held, wherein the four conductors emerge from the insulator part at the cable-side end. All four conductors are introduced from the side into the insulator part through the lateral opening which is closed with the cover.

Alternatively or additionally, the plug connector according to the invention can exhibit some or all of the features described above in any combination, wherein in order to avoid repetitions reference is made to the paragraphs in the description above.

According to a particularly preferred embodiment, the cover is connected with the insulator part via a hinged joint and in the finished plug connector is swiveled into a closed position in which it lies against an edge of the insulator part which at least partially surrounds the lateral opening in such a way at least that no sealing compound can penetrate between the edge of the lateral opening and the cover.

Preferably, the plug connector according to the invention has a locking mechanism holding the cover in the closed position in order to prevent an independent opening of the cover during filling. For this purpose, the cover can have, on the one hand, a cover surface which covers the outer boundary surface of the insulator part containing the lateral opening, and on the other hand locking elements projecting from the cover surface with engaging sections which engage in engaging sections such as clip-in openings of the insulator part.

In addition, clipping the engaging sections of the locking elements into engagement allows a contact section of the insulator part at the cable-side end of the insulator part to be pressed from two sides against the emerging conductors, so that no sealing compound can penetrate into the guide channel at the cable-side end of the insulator part either.

According to a further aspect, the present invention relates to an insulator part of a plug connector according to the invention. The insulator part preferably has several guide channels running next to one another to accommodate conductors such as wires or stranded conductors which emerge from the insulator part at a cable-side end. The conductors can be introduced into the guide channel via a lateral opening. The insulator part also has a covering, for example a cover, for closing the lateral opening, so that no sealing compound can penetrate into the interior of the insulator part during filling.

The insulator part is preferably configured to provide an angle plug connector and has a plug-side end which can be plugged in a plugging direction in the direction of a mating plug connector. The plugging direction is oriented at an angle, preferably ninety degrees (90°), to the direction in which the conductors emerge from the guide channel.

The cover can be clipped into a closed position in which it closes the lateral opening by means of a locking mechanism as discussed above.

In the following description the invention is described with reference to the enclosed drawings.

FIGS. 1*a* to 1*d* illustrate four steps of the method according to the invention for producing an angle plug connector 100 (as identified in FIG. 2) with a plug-side end 110 for coupling with a mating plug connector and a cable-side end 120 at which the several (in this case, by way of example, four) conductors emerge from the plug connector.

The four conductors 30 and an insulator part 20 for holding the four conductors 30 are shown, on the one hand with a view of the cable-side end of the insulator part (left) and on the other hand in a side view (right). The four conductors 30 are accommodated in four guide channels 12 of the insulator part 20. The insulator part 20 with the four introduced conductors 30 is then cast in a plug connector housing 40 in order, in this way, to prevent the penetration of water into the interior of the plug connector 100.

FIG. 1*a* shows the four conductors 30 prior to being introduced into the guide channels 12 of the insulator part 20 through a lateral opening 25. The conductors 30, in the form of stranded conductors, are introduced through the lateral opening 25 into the guide channels 12 in the plugging direction S until they make contact with contact elements of the plug connector in the interior of the insulator part 20. The four conductors 30 are curved (see FIG. 1*b*) in such a way that they emerge from the insulator part 20 at the cable-side end of the insulator part 20 in an exit direction which is oriented substantially perpendicular to the plugging direction. When inserting the conductors 30, flexible contact sections 14 of the insulator part 20 yield outwards slightly and then snap back into their starting position, so that the contact sections 14 lie closely against the conductors 30 (see FIG. 1*b*).

Figure 1B:
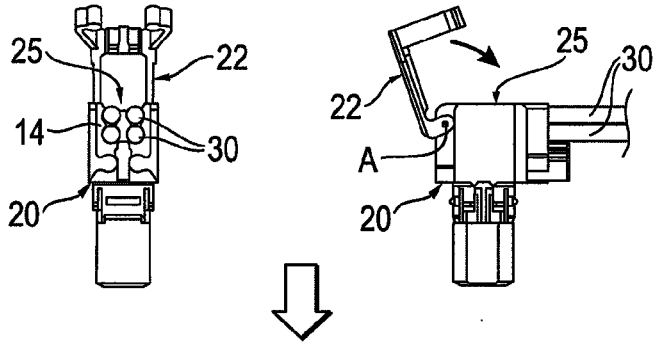

FIG. 1*b* depicts the lateral opening 25 of the guide channels 12, open at the top, as well as a cover 22 attached swivelably to the insulator part 20 which is in an open position in which it exposes the lateral opening 25.

Figure 1C:
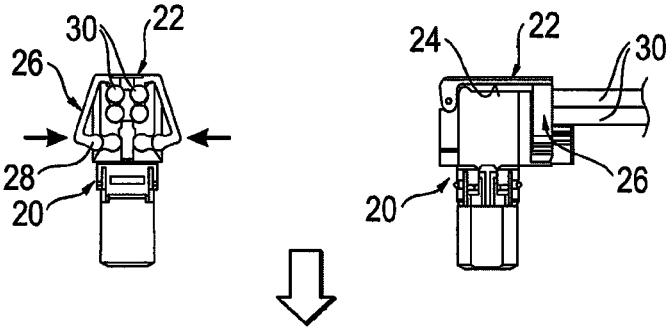

As illustrated in FIG. 1*c*, the cover 22 can be around a swivel axis A into a closed position in which it covers and seals the lateral opening 25. In the closed position, a cover surface 24 of the cover lies flat against an edge of the lateral opening 25. Two locking elements 26 in the form of elastic struts project perpendicularly from the cover surface 24 such that the conductors 30 are arranged on the cable-side end of the insulator part 20 between the locking elements 26. Engaging sections 28 provided on the locking elements 26 do not yet engage in clip-in openings of the insulator part 20 (see FIG. 1*c*, left).

Figure 1D:
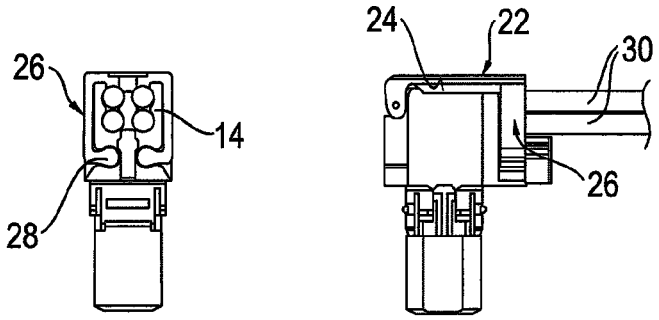

In order to lock the cover 22, the two locking elements 26 are pressed together, as a result of which the engaging sections 28 clip into the associated clip-in opening (see FIG. 1*d*, left). The cover 22 can no longer become detached.

In addition, the cover 22 is pressed firmly against the edge of the lateral opening 25 by the locking elements 26. The locking elements 26 also press the contact region 14 of the insulator part 20 from two sides against the conductors 30 and in this way seal the cable-side end of the guide channels 12 against the penetration of sealing compound.

Figure 3:
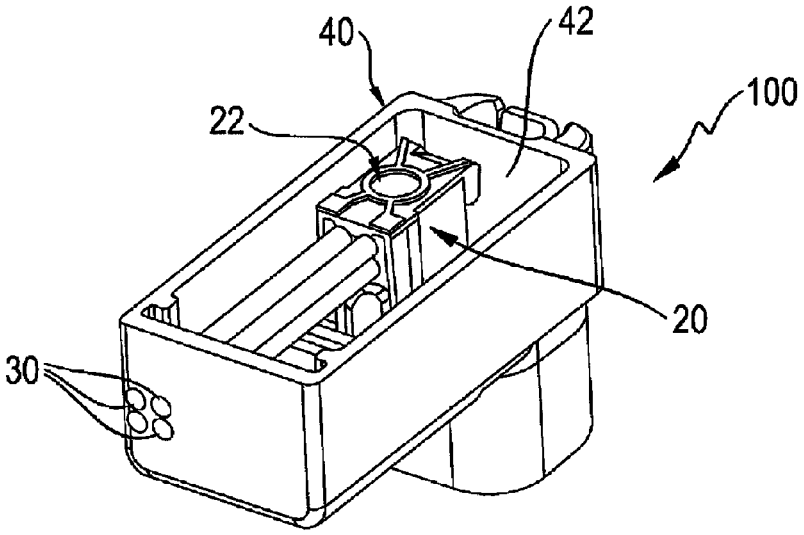
FIG. 3 shows a perspective view of a plug connector according to the invention prior to filling.

As shown in FIG. 3, the closed and locked insulator part 20 is arranged in a trough section of a plug connector housing 40, wherein the trough section has a fillable internal volume 42. This internal volume 42 is cast in a hardenable sealing compound which, because of the cover 22, cannot penetrate into the interior of the insulator part 20 or into the guide channels 12.

Figure 2:
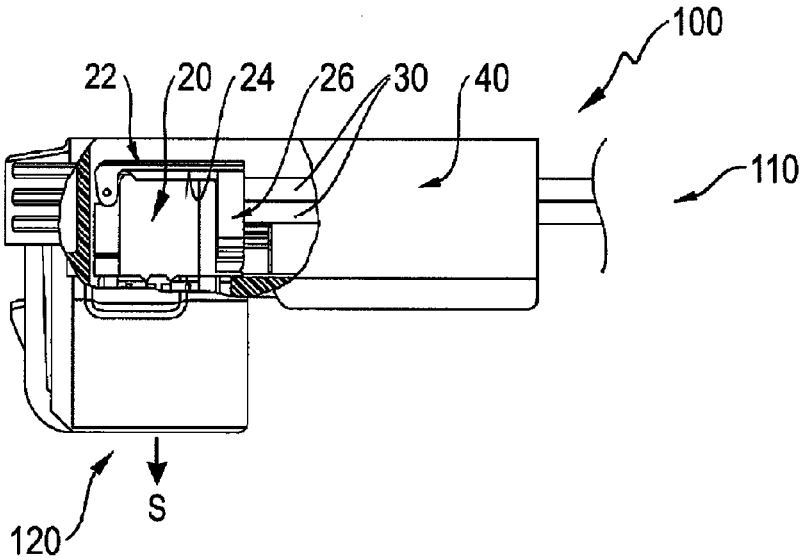
FIG. 2 shows a side view of a plug connector according to the invention.

A plug connector according to the invention 100 with a plug connector housing 40 with cast-in insulator part 20 with closed cover 22 is shown in a side view in FIG. 2. The position of the insulator part 20, with the conductors 30 which emerge from the insulator part 20 at the cable-side end, in the interior of the plug connector housing 40 is partially shown for the purpose of illustration.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A method for producing a water-tight plug connector in which at least one electric conductor is introduced into a guide channel of an insulator part via a lateral opening in order to hold the conductor, the insulator part with the introduced conductor is arranged in a plug connector housing, and an internal volume of the plug connector housing is then at least partially filled with a sealing compound, such that the lateral opening is closed prior to filling.

2. The method of claim 1, wherein the lateral opening is covered with a cover.

3. The method of claim 2, wherein the cover, attached to the insulator part so as to swivel around a swivel axis, (A), is swiveled into a closed position in which it lies against an at least partially peripheral edge of the lateral opening.

4. The method of claim 2, wherein the cover is locked into a closed position.

5. The method of claim 1, wherein the cover has a cover surface for covering the lateral opening and at least two locking elements projecting transversely to the cover surface, with engaging sections which are each clipped into a clip-in opening of the insulator part.

6. The method of claim 1, wherein the plug connector is an angle plug connector, such that the at least one conductor is substantially introduced into the insulator part through the lateral opening in a plugging direction (S) of the plug connector and runs in such a curve that it emerges from the insulator part on the cable side at an angle to the plugging direction (S).

7. A water-tight plug connector having at least one electric conductor introduced into a guide channel of an insulator part via a lateral opening in order to hold the conductor, the insulator part with the introduced conductor being arranged in a plug connector housing, and an internal volume of the plug connector housing then being at least partially filled with a sealing compound, such that the lateral opening is closed prior to filling, the insulator part cast into a plug connector housing with a guide channel within which the at least one electrical conductor is held, such that a lateral opening of the guide channel of the insulator part is closed with a cover.

8. The plug connector of claim 7, wherein the cover is connected with the insulator part via a hinged joint and is swiveled into a closed position in which it lies against an edge of the insulator part which at least partially surrounds the lateral opening.

9. The plug connector of claim 7, including a locking mechanism holding the cover in a closed position with locking elements projecting from a cover surface of the cover with engaging sections which engage in clip-in openings of the insulator part.

10. An insulator part for a water-tight plug connector, the insulator part having a guide channel for receiving at least one electric conductor via a lateral opening in order to hold the conductor, the insulator part with the introduced conductor being arranged in a plug connector housing, and an internal volume of the plug connector housing then being at least partially filled with a sealing compound, such that the lateral opening is closed prior to filling, the insulator part cast into a plug connector housing with a guide channel within which the at least one electrical conductor is held, such that a lateral opening of the guide channel of the insulator part is closed with a cover.

11. The method of claim 3, wherein the cover is clipped into a closed position.

12. The method of claim 5, wherein the cover has a cover surface for covering the lateral opening and at least two locking elements projecting approximately perpendicular to the cover surface, with engaging sections which are each clipped into a clip-in opening of the insulator part.

13. The method of claim 11, wherein the cover has a cover surface for covering the lateral opening and at least two locking elements projecting transversely to the cover surface, with engaging sections which are each clipped into a clip-in opening of the insulator part.

14. The method of claim 6, wherein the plug connector is an angle plug connector, such that the at least one conductor is substantially introduced into the insulator part through the lateral opening in a plugging direction (S) of the plug connector and runs in such a curve that it emerges from the insulator part on the cable side approximately perpendicular to the plugging direction (S).

15. The method of claim 13, wherein the plug connector is an angle plug connector, such that the at least one conductor is substantially introduced into the insulator part through the lateral opening in a plugging direction (S) of the plug connector and runs in such a curve that it emerges from the insulator part on the cable side approximately perpendicular to the plugging direction (S).

16. The plug connector of claim 8, including a locking mechanism holding the cover in a closed position with locking elements projecting from a cover surface of the cover with engaging sections which engage in clip-in openings of the insulator part.

* * * * *